US010236090B1

(12) United States Patent
Areti et al.

(10) Patent No.: US 10,236,090 B1
(45) Date of Patent: Mar. 19, 2019

(54) SYNTHESIZING RADIOISOTOPES USING AN ENERGY RECOVERY LINAC

(71) Applicant: Jefferson Science Associates, LLC, Newport News, VA (US)

(72) Inventors: Hari Areti, Suffolk, VA (US); Andrew Kimber, Poquoson, VA (US); Andrew Hutton, Newport News, VA (US); David Douglas, Yorktown, VA (US); Rui Li, Yorktown, VA (US); Geoff Krafft, Newport News, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 727 days.

(21) Appl. No.: 13/935,538

(22) Filed: Jul. 4, 2013

(51) Int. Cl.

| | |
|---|---|
| ***G21G 1/12*** | (2006.01) |
| ***G21G 1/10*** | (2006.01) |
| ***H05H 7/00*** | (2006.01) |
| *G21G 4/00* | (2006.01) |

(52) U.S. Cl.
CPC ..... *G21G 1/12* (2013.01); *G21G 1/10* (2013.01); *H05H 7/001* (2013.01); *G21G 4/00* (2013.01)

(58) Field of Classification Search
CPC .. G21G 1/10; G21G 1/12; G21G 4/00; G21G 4/06; H05H 7/001; H05H 7/10; H05H 2007/007
USPC ..... 376/156
See application file for complete search history.

(56) References Cited

U.S. PATENT DOCUMENTS

| | | | | | |
|---|---|---|---|---|---|
| 4,484,339 | A * | 11/1984 | Mallozzi | G21G 4/00 | 378/119 |
| 5,784,423 | A * | 7/1998 | Lidsky | G21G 1/10 | 376/156 |
| 7,391,850 | B2 * | 6/2008 | Kaertner | H05G 2/00 | 378/118 |
| 2002/0190670 | A1 * | 12/2002 | Pappo | H05H 7/20 | 315/500 |
| 2012/0288065 | A1 * | 11/2012 | Graves | H05G 2/00 | 378/119 |
| 2013/0083880 | A1 * | 4/2013 | Noonan | G21G 1/10 | 376/190 |

* cited by examiner

*Primary Examiner* — Sharon M Davis

(57) ABSTRACT

An apparatus and method for the production of radioisotopes utilizing an energy recovery linac. The ERL system is composed of an electron beam source, multiple superconducting radio frequency cavities operating at 4.5 K, a thin radiator, a target material, and a beam dump. The accompanying method discloses the use of the ERL system to generate desired radioisotopes via target interaction with bremsstrahlung photons while allowing recovery of a substantial portion of the electron beam energy before the beam is extracted to the beam dump.

1 Claim, 4 Drawing Sheets

| *Parameter* | *Value* |
|---|---|
| Electron beam energy, $E$ | 50 MeV |
| Beam current, $I$ | 3 mA |
| $e^-/\gamma$ conversion rate | 0.003 photons/electron |
| Photon flux, $\Phi\gamma$ | $5.6 \times 10^{13}$ photons/s |
| $\gamma$ rms divergence, $\sigma_{x'}$ | 26 mrad |
| Radiator material | Al |
| Thickness of radiator | 0.5% radiation length |
| Target material | Zn |
| Radius of target | 5 cm |
| Radiator-target distance | 1 m |
| Photonuclear reaction rate | $8.5 \times 10^{10}$ interactions/s |
| Time to make 1mCi of $^{67}Cu$ | 142 s |
| Estimated cost of 1mCi | $ 1.18 |
| Estimated power draw | ~500 kW |

FIG. 4

SYNTHESIZING RADIOISOTOPES USING AN ENERGY RECOVERY LINAC

The United States of America may have certain rights to this invention under Management and Operating Contract No. DE-AC05-84ER 40150 from the Department of Energy.

FIELD OF THE INVENTION

The present invention relates generally to radioisotope production, and, more particularly, to an apparatus and method for producing radioisotopes using linear accelerators.

BACKGROUND OF THE INVENTION

Recent technological advances, especially in the fields of diagnostic and therapeutic medicine, require ever-increasing quantities of radioactive isotopes. These radioisotopes are typically produced via irradiation of target materials in a small number of nuclear reactors or cyclotron accelerators across the globe. Isotopes produced in reactors are mainly from the neutron, gamma (n, γ) reaction (radiative capture). By contrast, cyclotrons bombard a target with a stream of heavy, charged particles (commonly protons).

The highly desired radioisotopes are generally produced by a limited number of large facilities yielding a small variety of isotopes. Isotope selection is also limited, because the most useful isotopes often have short half-lives, making transportation a problem. The specific use of nuclear reactors also has the disadvantage of creating radioactive waste that is becoming increasingly problematic.

A direct consequence of these limitations is that research and development in certain areas has stagnated because of the issues with production, transportation and economies of scale. Numerous industrial sectors would benefit from a compact, efficient, clean source of isotopes that is geographically close to the point of use, so as to take advantage of shorter half-life variants.

It is therefore preferable to have a system and method that optimizes the production of the pertinent radioisotopes while minimizing the total energy needed for commercial production. The instant invention provides a solution to the foregoing problems.

OBJECT OF THE INVENTION

It is an object of the invention to provide a system and method that optimizes the production of certain radioisotopes while minimizing total energy requirements for such production.

It is a further object of the invention to provide a system and method to produce a more diverse and reliable domestic supply of short-lived, high-value, high-demand isotopes at a cost lower than those extracted by reactors or positive-ion accelerators.

It is also an object of the invention to provide a method of production of desired radioisotopes which does not result in the production of radioactive waste.

SUMMARY OF THE INVENTION

The present disclosure provides a low cost, high output, eco-friendly system and method of radioisotope production based upon an energy recovery linear particle accelerator. An electron beam is accelerated in multiple 4.5 K SRF cavities and passed through a radiator where bremsstrahlung photons are created. The photons then hit a target for desired radioisotope production. The remaining electrons from the beam are sent back through the accelerator (SRF cavities) in deceleration mode, 180° out of phase, thereby regaining most of the RF energy prior to extraction at a beam dump.

More specifically, one embodiment of the invention utilizes a 10 mA 50 MeV electron beam which is accelerated and energy recovered by 352 MHz SRF cavities at 4.5 K with 170 mm aperture. A cryomodule for the SRF accelerating cavities operates at 4.5 K providing, inter alia, substantially reduced technical complexity and power consumption.

BRIEF DESCRIPTION OF THE DRAWINGS

FIG. 4 is a table providing an illustrative, non-exhaustive list of system parameters for one embodiment.

DETAILED DESCRIPTION

The present invention discloses a system and method for a radioisotope production facility based upon the premise that photonuclear reactions with bremsstrahlung photon beams from electron linacs can be used to generate isotopes of critical interest.

Energy recovery linear accelerators ("ERL") are increasingly the technology of choice for highly demanding applications. In energy recovery systems, more than 90% of the beam power is recycled, i.e., not deposited in a beam dump. The energy of the waste beam is therefore lower than the threshold for neutron production and the activation of shield components, thereby reducing both complexity and cost. ERLs offer superior beam characteristics well suited to isotope production. Of critical importance, as disclosed herein, energy recovery of an electron beam which has passed through a radiator can be accomplished.

Figure 1:
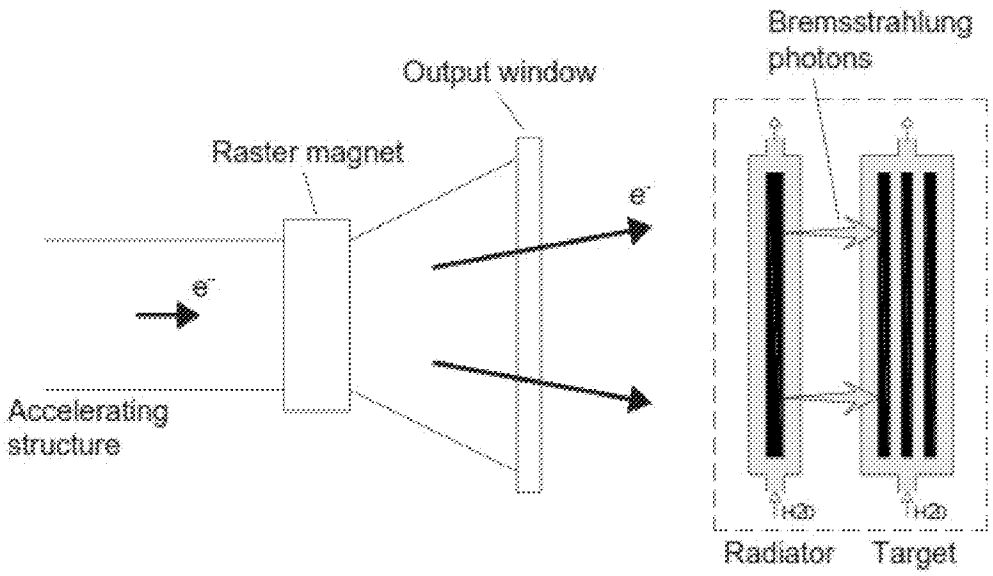
FIG. 1 illustrates a schematic layout of a photonuclear reaction involving a radiator and target material.

The Electron linacs proposed herein use a radiator to produce bremsstrahlung photon beams which interact with a target which creates isotopes of interest, as shown in FIG. 1. Bremsstrahlung or "braking radiation" is produced as charged particles (electrons) slowed down in their interaction with matter (the radiator).

Figure 2:
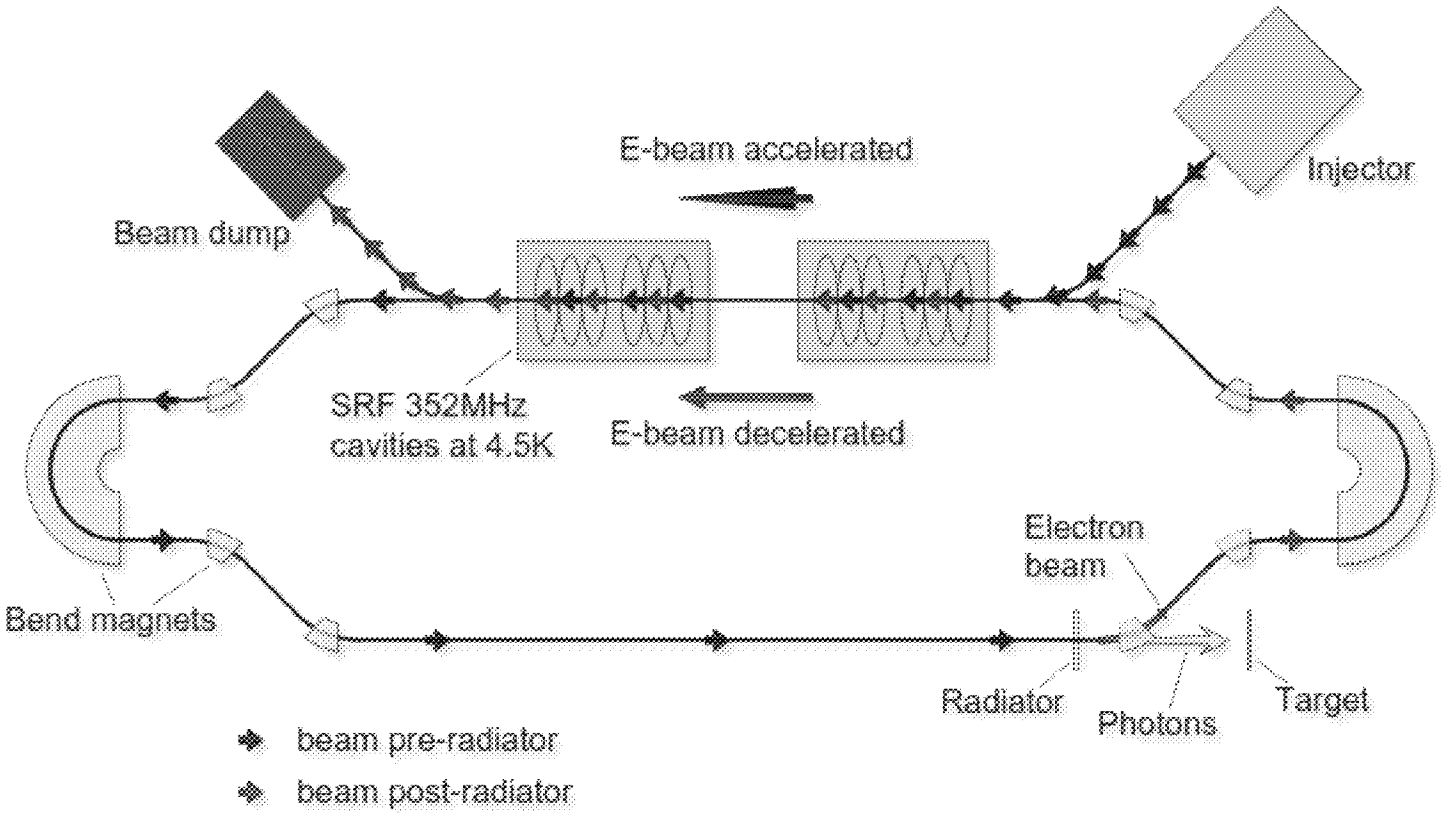
FIG. 2 provides a schematic layout of one embodiment of an ERL isotope production system.

Referring now to FIG. 2, one potential embodiment of an ERL-based isotope production facility is illustrated schematically. The system begins with an injector, which provides the electron beam bunches, typically a laser-driven photocathode. This continuous wave electron beam is then accelerated by one or more SRF cavities. Typical accelerating gradients are 10-15 MV/m. The cavities are submerged in a helium bath within a cryomodule. The beam is steered and focused with magnets and beamline components until it is delivered to the target apparatus.

The beam passes through a radiator composed of suitable material where bremsstrahlung photons are created. These photons in turn hit a target for radioisotope production. Instead of sending this beam to a dump (and wasting its energy and causing activation), the spent beam is steered back through the SRF cavities, 180° out of phase, so that it is decelerated and the energy recovered before being extracted to the beam dump. This recovered energy is returned to the RF structure, ready to accelerate the next bunch that passes through.

For energy recovery to be efficient the cavities of a linac need to a) have a high accelerating gradient to give maximum acceleration per unit length of linac, and b) have low inherent losses in the accelerating structure. This naturally leads to the use of SRF over normal conducting copper structures because they possess both qualities. There is of course the added cost of the associated cryogenic systems that are required, but many studies suggest that during the operational lifetime of similar facilities the accumulated cost is significantly less.

The instant ERL system is designed for operating at 4.5 K rather than the standard 2 K. This slightly elevated temperature means substantially reduced technical complexity and power consumption, and, moreover, can be achieved using commercially available refrigeration systems. The emphasis is on 4.5 K operation in order to utilize lower frequencies and optimize the design for low heat loss. The cost of a 400 W, 4.5 K helium refrigerator is approximately $4M. A 2 K plant would cost twice that, and be more complicated and costly to run. The surface resistivity of SRF materials scales with the square of the RF frequency and exponentially with temperature below the critical point.

Therefore, operating in CW mode at 4.5 K requires lowering the frequency and reducing the gradients to achieve low heat loads and low operating costs. A useful result of using lower-frequency cavities is that the aperture size increases with decreasing frequency. The larger the aperture, the more disruption to the beam can be tolerated by the downstream components (including the cavities which harvest the energy of the 'spent' beam). In practical terms, a larger percentage radiator can be used, which produces more photons and hence reduces the time to produce a certain quantity of isotopes.

The interaction between the electron beam energy, the beam current and the properties of the radiator material will define the photon spectra emitted via bremsstrahlung. As a consequence of this process, the features of the electron beam after the radiator will be degraded. The properties of photon spectra and the target material determine the yield of the reaction.

Figure 3:
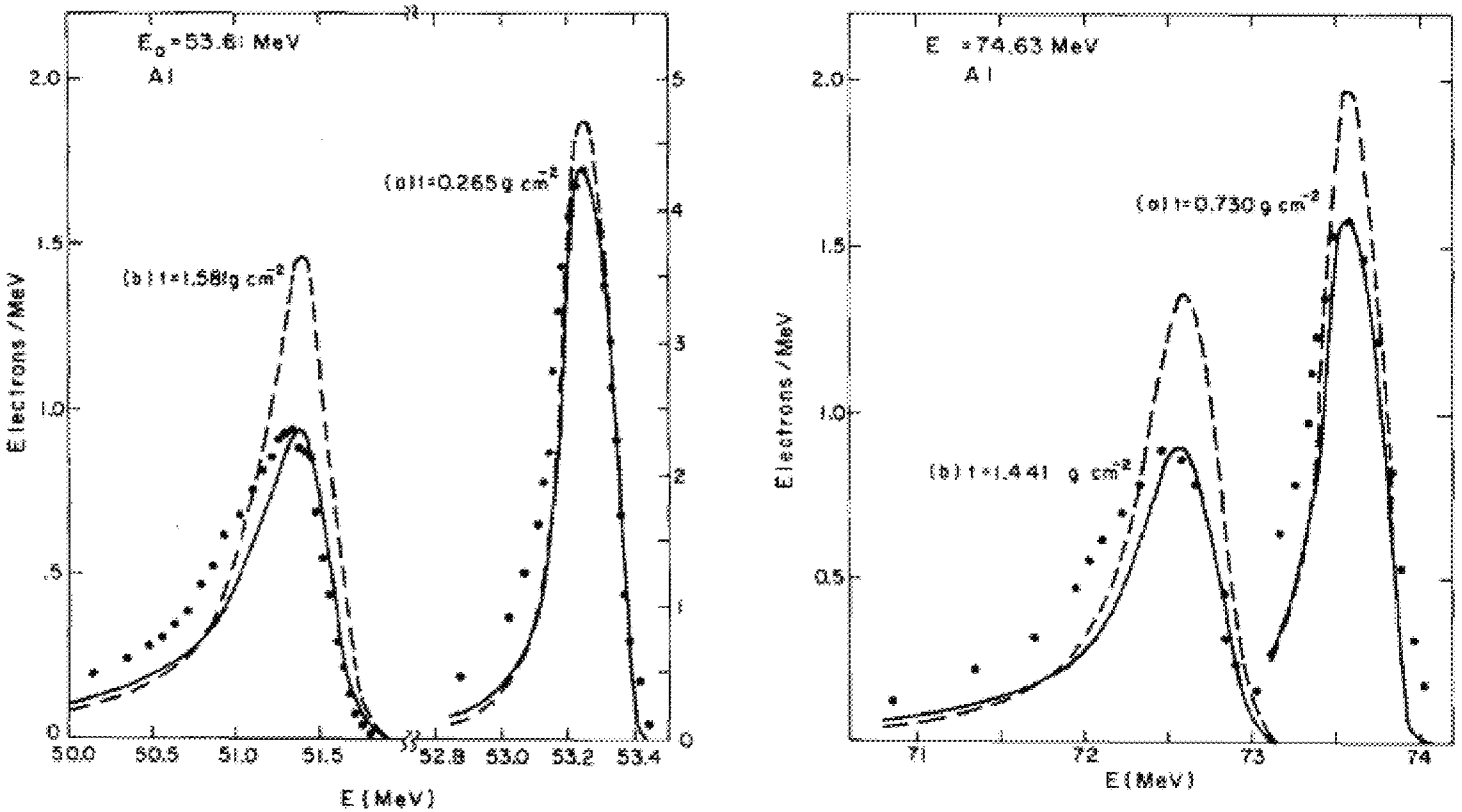
FIG. 3 is a chart showing loss distribution through a radiator.

A thin radiator composed of a suitable material, such as Tungsten, is used. An overly thick radiator may lead to excessive energy loss thereby impairing recirculation. Conversely, the radiator must be of sufficient dimensions so as to produce satisfactory amounts of bremsstrahlung radiation. Approximately 99% of the electron beam will pass straight through the radiator. A limit to energy recovery is set by the loss distribution through the radiator. FIG. 3 shows the experimental and theoretical loss distribution of a 53.61 MeV beam and a 74.63 MeV beam through a 1% and 6% Al radiator. It shows that the average energy loss in a 1% radiator is 0.378 MeV with a FWHM of 0.2 MeV. Studies at Jefferson Laboratory's free-electron laser indicate an acceptance limit on energy loss of 10-15% at 135 MeV. The spread in angles of a 50 MeV electron beam going through a 0.5% radiator is 26 mrad at 1 m. The radiator-induced increase in angular divergence must also be managed to permit efficient energy recovery, as discussed below.

In order to demonstrate the potential performance of an electron linac based system, several important parameters must be looked at, e.g., the electron beam, the radiator performance (to understand the photon production rate) and the rate of isotope production in the target itself. For illustrative purposes, FIG. 4 sets forth various pertinent parameters in this system and the values for each with regard to one particular radioisotope, $^{67}$CU.

It will be noted that while FIG. 4 addresses the production of $^{67}$Cu this system is not limited to the production of one specific isotope. Nonetheless, $^{67}$Cu is an example of an isotope produced through the photonuclear reaction $^{68}$Zn(γ, p)$^{67}$Cu, and is ideally suited to be produced with an ERL. Using the foregoing parameters along with the standard linac operation parameters, the time it would take to produce 1 mCi of $^{67}$Cu is 142 seconds. Since the production rate is so high this system allows for the production of many curies of radioisotope before the decay rate becomes a problem. Using the foregoing rate of production, the estimated power cost would be $1.18 per mCi of $^{67}$Cu. These estimates demonstrate the potential cost savings of an ERL-based isotope production system.

In the design of a high power ERL for isotope production, the electron beam will acquire large energy and angular spread through the interaction with the radiator target. The beam-target interaction will also generate a small fraction of secondary electrons which may act like a halo moving along with the core beam, which may cause cavity quenching and thus make high power operation unfeasible. To harness the high efficiency of ERL technology and use the ERL generated high power electron beam for isotope production, it is important to implement halo management schemes to control beam losses, and design the machine optics so that the exhausted beams with large energy or angular spread can be transported and dumped cleanly after energy recovery.

With regard to the increase in the beam emittance and energy spread at the target, at E=50 MeV, for example, the electron beam going through an aluminum target with 0.5% radiation length can acquire 18 mrad rms angular spread, which is two orders of magnitude bigger than the typical beam divergence in a standard free-electron laser operation. Such large beam divergence poses significant challenges for the energy recovery in the linac and also for the beam transport to the dump. In general, the target arrangement, such as target type and thickness, determines the energy and angular spread of the spent electron beam at exit of the target. This spread, together with the beam spot size at target, further set specific requirements on the acceptance of the recirculation optics.

Target heating is a potentially serious issue when using a high current electron beam in an ERL incident on a radiator where gamma photons are generated. With given electron beam power, the target heating tolerance (heat load per unit area) will set a lower limit for the beam spot size on the target. Meanwhile, the minimum achievable beam spot size on the target plays a defining role on the increase of beam emittance due to beam-target interaction, which will further determine whether the electron beam can be optically accepted by the downstream optics for the beam to be energy recovered in the linac. In many cases target heating can be circumvented by applying schemes, such as a cooling system or beam rastering systems, to increase the target heating tolerance.

Basic considerations in the longitudinal and transverse match must be considered. For the longitudinal phase space, the interaction of the electron beam with the radiator will result in a large increase in beam energy spread while keeping the bunch length intact. The growth of longitudinal emittance can be minimized by having the beam reach minimum bunch length at the target position. This requires the longitudinal matching on the target similar to the matching at the wiggler for the FEL operation.

For the transverse phase space, the beam divergence blows up dramatically from the beam-target interaction. To minimize the transverse emittance growth, the beam at the target needs to be matched to a minimal spot size in both the horizontal and vertical dimension. The beam after the target is mismatched to the downstream acceptance, and therefore the downstream acceptance needs to be reworked to rematch the output beam from target. The smaller the beam spot size at the target, the smaller is the emittance growth and the less difficult is the optics adjustment for divergence acceptance. This, however, is constrained by the minimum tolerable spot size at the target. For a given target arrangement, the lower limit of beam spot size is set by the target heat tolerance, while the upper limit is set by the maximum achievable optical acceptance for the beam line from the target to the back end of the linac after the beam is energy recovered.

Taking all of the foregoing points into consideration, the design of a high power ERL based isotope production system requires attention to the impact of the beam spot size and target type and thickness on target heating, and on the maximum acceptance of the beam in downstream optics for energy recovery. With careful tuning of optics, the acceptance downstream of the target can be made such that energy recovery is feasible. Indeed, under ideal conditions, only around 10% of the electron beam energy is deposited in the beam dump and 90% or more of the electron beam energy is recovered.

This method of isotope production, relying upon an electron accelerator, offers the potential for higher production yields for certain isotopes over more traditional methods. Further, since the linac energy is tunable, the resulting gamma energy can be optimized for isotope production cross sections. Highly focused (of the order of 100 μm) gamma rays can be generated, making it possible to produce radioisotopes with high activity in a small volume.

Electron linacs, and in particular the system and method set forth herein, also offer other unique advantages over traditional techniques. One of the principal advantages is that such systems are reasonably simple devices to operate and maintain. This new and innovative approach using ERL technology has a number of advantages:

i. Simplified separation of a desired isotope after production.
ii. Energy recovery means greater overall (wall plug) efficiency.
iii. Energy recovery allows a reduction in beam energies, to below the threshold of neutron production, lost to beam dumps.
iv. Electron linacs are reasonably simple devices to operate and maintain. A production facility could be run by a relatively small group of technicians.
v. Unlike methods relying upon a nuclear reactor, the ERL machine could be instantly powered down.
vi. End of life decommissioning is simpler, cleaner and less costly than other technologies.
vii. Smaller machine footprint allows flexibility in the placement and location of production facilities.

The system and method disclosed herein provides efficiency and flexibility that can also be used to solve additional problems inherent in the current methods of isotope production. At this time, few options exist for getting isotopes to desired locations. Isotope selection is also limited, because the most useful isotopes often have short half-lives, making transportation a problem.

A facility incorporating the apparatus and system set forth herein could be built in a hospital basement or in a distribution center within close geographic proximity of multiple hospitals and research establishments. The availability of new isotopes would open a frontier of innovative research and treatments and would help drive down production costs.

While the invention has been described in reference to certain preferred embodiments, it will be readily apparent to one of ordinary skill in the art that certain modifications or variations may be made to the system without departing from the scope of the invention claimed below and described in the foregoing specification.

What is claimed is:

1. A method for the production of radioisotopes utilizing an energy recovery linear accelerator, the method comprising:

providing an energy recovery linear accelerator apparatus having a beam path; said apparatus including an electron beam source and a radiator;

providing an isotope production target material which is spatially separated from said radiator at a distance of one meter such that said target material is not within the beam path of said energy recovery linear accelerator, wherein the dimensions of said target material have no effect on the amount of energy recovered from said electron beam;

generating a continuous wave electron beam;

accelerating the electron beam in one or more SRF cavities;

striking said radiator with said beam;

generating Bremsstrahlung radiation as a result of said striking said radiator;

bombarding said target material with said Bremsstrahlung radiation;

manipulating and decelerating said electron beam;

recovering at least ninety percent of the energy from said electron beam; and absorbing the electron beam at a beam dump.

* * * * *